US005105836A

United States Patent [19]

Gentry et al.

[11] Patent Number: 5,105,836

[45] Date of Patent: Apr. 21, 1992

[54] CIGARETTE AND SMOKABLE FILLER MATERIAL THEREFOR

[75] Inventors: Jeffery S. Gentry, Pfafftown; Gary R. Shelar, Greensboro; Richard L. Lehman, Belle Mead; James L. Resce, Yadkinville; Olivia D. Furin, Winston-Salem; Stephen W. Jakob, Winston-Salem; William C. Squires, Winston-Salem, all of N.C.

[73] Assignee: R. J. Reynolds Tobacco Company, Winston-Salem, N.C.

[21] Appl. No.: 567,520

[22] Filed: Aug. 15, 1990

Related U.S. Application Data

[63] Continuation-in-part of Ser. No. 414,833, Sep. 29, 1989.

[51] Int. Cl.[5] ..... A24B 15/14; A24D 1/18

[52] U.S. Cl. ..... 131/359; 131/355; 131/369

[58] Field of Search ..... 131/359, 369, 355

[56] References Cited

U.S. PATENT DOCUMENTS

| | | |
|---|---|---|
| 2,217,527 | 10/1940 | Roon . |
| 2,907,686 | 10/1959 | Siegel . |
| 3,112,754 | 12/1963 | Diaz . |
| 3,319,630 | 5/1967 | Orrmins . |
| 3,353,543 | 11/1967 | Sproull et al. . |
| 3,355,317 | 11/1967 | Keith et al. . |
| 3,395,714 | 8/1968 | Kahane et al. . |
| 3,484,322 | 12/1969 | Inskeep . |
| 3,511,247 | 5/1970 | Tamol . |
| 3,526,904 | 9/1970 | Tamol . |
| 3,608,560 | 9/1971 | Briskin et al. . |
| 3,615,811 | 10/1971 | Barrett . |
| 3,633,589 | 1/1972 | Kahane et al. . |
| 3,638,660 | 2/1972 | Davis . |
| 3,664,352 | 5/1972 | Norman et al. . |
| 3,699,973 | 10/1972 | Tamol et al. . |
| 3,705,588 | 12/1972 | Tamol et al. . |
| 3,738,374 | 6/1973 | Bennett . |
| 3,744,496 | 7/1973 | McCarty et al. . |
| 3,805,799 | 4/1974 | Stewart, Jr. et al. . |
| 3,834,398 | 9/1974 | Briskin et al. . |
| 3,861,401 | 1/1975 | Briskin et al. . |
| 3,874,390 | 4/1975 | Eicher et al. . |
| 3,885,574 | 5/1975 | Borthwick et al. . |
| 3,902,504 | 9/1975 | Owens, Jr. et al. . |
| 3,911,932 | 10/1975 | Houck, Jr. et al. . |
| 3,924,644 | 12/1975 | Anderson et al. . |
| 3,931,824 | 1/1976 | Miano et al. . |
| 3,943,941 | 3/1976 | Boyd et al. . |
| 3,943,942 | 3/1976 | Anderson et al. . |
| 3,965,911 | 6/1976 | Anderson et al. . |
| 3,993,082 | 11/1976 | Martin et al. . |
| 4,014,349 | 3/1977 | Morman et al. . |
| 4,019,520 | 4/1977 | Strubel et al. . |
| 4,019,521 | 4/1977 | Briskin . |
| 4,044,777 | 8/1977 | Boyd et al. . |
| 4,079,742 | 3/1978 | Rainer et al. . |
| 4,133,317 | 1/1979 | Briskin . |
| 4,219,031 | 8/1980 | Rainer et al. . |
| 4,225,636 | 9/1980 | Cline et al. . |
| 4,231,377 | 11/1980 | Cline et al. . |

(List continued on next page )

FOREIGN PATENT DOCUMENTS

| | | |
|---|---|---|
| 0117355 | 8/1983 | European Pat. Off. . |
| 0342538 | 12/1989 | European Pat. Off. . |
| 0386868 | 9/1990 | European Pat. Off. . |
| 1185887 | 3/1970 | United Kingdom . |

*Primary Examiner*—V. Millin

*Attorney, Agent, or Firm*—August J. Borschke

[57] ABSTRACT

A combustible smokable filler material includes an agglomerated matrix filler having an inorganic component (e.g., particles of calcium carbonate) and a carbonaceous component (e.g., calcined molasses). The smokable filler material includes a binding agent and an aerosol forming material. Tobacco extracts and/or pieces of tobacco laminae can be incorporated into the smokable filler material, and/or the smokable filler material can be blended with tobacco cut filler. Cigarettes are provided by wrapping the smokable filler material in a paper wrapping material. A typical paper wrapping material has a porosity of less than about 5 CORESTA units.

42 Claims, 1 Drawing Sheet

U.S. PATENT DOCUMENTS 4,244,381 1/1981 Lendvay .
4,286,604 9/1981 Ehretsmann et al. .
4,326,544 4/1982 Hardwick et al. .
4,341,228 7/1982 Keritsis et al. .
4,407,308 10/1983 Baker et al. .
4,453,553 6/1984 Cohn .
4,461,311 7/1984 Mathews et al. .
4,481,958 11/1984 Rainer et al. .
4,489,738 12/1984 Simon .
4,505,282 3/1985 Cogbill et al. .
4,561,454 12/1985 Guess .
4,596,259 6/1986 White et al. .
4,607,647 8/1986 Dashley et al. .
4,624,268 11/1986 Baker et al. .
4,691,717 9/1987 Ikeda et al. .
4,700,726 10/1987 Townsend et al. .
4,715,389 12/1987 Lynm et al. .
4,730,628 3/1988 Townsend et al. .
4,744,987 5/1988 Mehra et al. .
4,759,380 7/1988 Norman et al. .
4,771,795 9/1988 White et al. .
4,892,590 1/1990 Gill et al. .
4,920,990 5/1990 Lawrence et al. .
4,924,888 5/1990 Perfetti et al. .
4,942,888 7/1990 Montoya et al. .

CIGARETTE AND SMOKABLE FILLER MATERIAL THEREFOR

CROSS-REFERENCE TO RELATED APPLICATION

This is a continuation-in-part of U.S. Patent application Ser. No. 414,833, filed Sep. 29, 1989, the disclosure of which is incorporated herein by reference.

BACKGROUND OF THE INVENTION

The present invention relates to cigarettes and other smoking articles, and in particular to cigarettes, which when smoked, yield relatively low levels of incomplete combustion products, generate low amounts of sidestream "tar" and odor, and sustain smolder during FTC smoking conditions.

Popular smoking articles, such as cigarettes, have a substantially cylindrical rod shaped structure and include a roll or charge of smokable material, such as shredded tobacco material (e.g., in cut filler form), wrapped in a paper wrapper, thereby forming a so-called "smokable rod". Normally, a cigarette has a cylindrical filter element aligned in an end-to-end relationship with the smokable rod. Typically, a filter element includes cellulose acetate tow circumscribed by plug wrap, and is attached to the smokable rod using a circumscribing tipping material.

Typically, cigarettes are employed by the smoker by lighting one end thereof and burning the smokable rod. As such, smoke normally is provided by burning smokable material, which typically is tobacco cut filler. The smoker then receives mainstream smoke (e.g., mainstream tobacco smoke) into his/her mouth by drawing on the opposite end (e.g., the filter end) of the cigarette. As such, the smoker is provided with the pleasures of smoking (e.g., smoking taste, feel, satisfaction, and the like).

During the time that the cigarette is burning, sidestream smoke is generated. Sidestream smoke is smoke which directly enters the atmosphere from the lit end of the cigarette. Sidestream smoke diffuses into the atmosphere, and the characteristic visible nature and odor thereof may be perceived negatively by some individuals. The relative amount of visible sidestream smoke generated by a burning cigarette is related to the amount of sidestream "tar" generated by that burning cigarette. Typical commercially available cigarettes which burn tobacco cut filler, and have lengths of about 84 mm (e.g., having a smokable rod length of about 57 mm and a filter element length of about 27 mm), often yield about 25 to about 35 mg of sidestream "tar" per cigarette. See, Proctor et al, Analyst, Vol. 113, p. 1509 (1988), for an apparatus and technique for determining the sidestream "tar" of a cigarette.

Numerous cigarettes which reportedly yield relatively low levels of visible sidestream smoke have been proposed. See, for example, U.S. Pat. Nos. 4,637,410 to Luke; 4,624,268 to Baker et al; 4,407,308 to Baker; 4,231,377 to Cline et al; 4,420,002 to Cline; 4,450,847 to Owens; 4,108,151 to Martin; 4,225,636 to Cline; 4,433,697 to Cline; 4,461,311 to Mathews et al; and 4,561,454 to Guess.

Through the years, there have been proposed various methods for altering the composition of mainstream tobacco smoke. For example, many tobacco substitute materials have been proposed, and a substantial listing of such materials can be found in U.S. Pat. No. 4,079,742 to Rainer et al. In addition, tobacco substitute smoking materials having the tradenames Cytrel and NSM were introduced in Europe during the 1970's.

Numerous references have proposed articles which generate flavored vapor and/or visible aerosol. Most of such articles have employed a combustible fuel source to provide an aerosol and/or to heat an aerosol forming material. See, for example, the background art cited in U.S. Pat. No. 4,714,082 to Banerjee et al.

Smoking articles which are capable of providing the pleasures associated with cigarette smoking, by heating but not necessarily burning tobacco, and without delivering considerable quantities of incomplete combustion products, are described in U.S. Pat. Nos. 4,714,082 to Banerjee et al; 4,756,318 to Clearman et al; and 4,793,365 to Sensabaugh, Jr. et al. Such smoking articles employ a combustible fuel element for heat generation; and aerosol forming substances positioned physically separate from, and in a heat exchange relationship with, the fuel element. During use, heat generated by the fuel element acts to volatilize the aerosol forming substances, thereby providing an aerosol which resembles tobacco smoke. Such smoking articles yield extremely low levels of visible sidestream smoke as well as low levels of FTC "tar".

It would be desirable to provide a good tasting cigarette which provides good smoking satisfaction, provides relatively low mainstream gas phase yields, provides relatively low levels of incomplete combustion products, sustains smolder during FTC smoking conditions, yields an ash having desirable physical characteristics, and generates low levels of sidestream "tar" and hence the low levels of visible sidestream smoke.

SUMMARY OF THE INVENTION

The present invention relates to smoking articles incorporating tobacco in cut filler form and/or in a processed form. Preferred smoking articles have the form of a cigarette having two essential components: (i) a roll or charge of smokable material, and (ii) an outer wrapping material (e.g., a paper wrapper) circumscribing the roll of smokable material. Cigarettes of the present invention incorporate a smokable filler material (described in greater detail hereinafter) as at least a portion of the smokable material thereof.

The preferred wrapping material, which surrounds the roll of smokable material to thereby form a "smokable rod", is a low air permeability cigarette paper wrapper. Highly preferred wrappers having a low air permeability or low porosity exhibit a porosity below about 5 CORESTA units. A CORESTA unit is a measure of the linear air velocity which passes through a 1 $cm^2$ area of wrapper at a constant pressure of 1 centibar. See CORESTA Publication ISO/TC 126/SC I N159E (1986).

One form of smokable material is a tobacco-containing smokable filler material. Such a smokable material of the present invention comprises an intimate mixture of (i) tobacco (e.g., shredded tobacco laminae milled tobacco laminae, pieces of tobacco stems, tobacco fines, tobacco dust, or a tobacco extract or other form of processed tobacco), and (ii) an agglomerated matrix filler. The agglomerated matrix filler has, in intimate contact, a carbonaceous component and an inorganic component. Preferably, the agglomerated matrix filler is provided in particulate form. The smokable filler material includes a binding agent in intimate contact with the agglomerated matrix filler and tobacco. As such, the binding agent acts to maintain particles of the tobacco and agglomerated matrix filler together to form the smokable filler material. Such a tobacco-containing smokable filler material also can include certain flavoring agents (e.g., cocoa, licorice, organic acids, menthol, and the like) and/or aerosol forming material (e.g., glycerin, propylene glycol, and the like) in intimate contact therewith. The tobacco-containing smokable filler material can be cast as a sheet from an aqueous slurry, provided as a sheet using a paper-making process, or provided in extruded form. Such a tobacco-containing smokable filler material can be employed individually as the sole smokable material of the cigarette, or that tobacco-containing smokable filler material can be physically mixed with (i.e., blended) or otherwise employed with other smokable materials, such as tobacco cut filler.

Another form of smokable filler material of the present invention comprises an agglomerated matrix filler. The agglomerated matrix filler has, in intimate contact, a carbonaceous component and an inorganic component. Preferably, the agglomerated matrix filler is provided in particulate form. The smokable filler material includes a binding agent in intimate contact with the agglomerated matrix filler. As such, the binding agent acts to maintain particles of agglomerated matrix filler together to form the smokable filler material. Such a smokable filler material also can include certain flavoring agents and/or aerosol forming materials in intimate contact therewith. The smokable filler material can be cast as a sheet from an aqueous slurry, provided as a sheet using a paper-making process, or provided in extruded form. Such a smokable filler material can be physically mixed with or otherwise employed with tobacco-containing smokable materials and/or tobacco cut filler.

DETAILED DESCRIPTION OF THE PREFERRED EMBODIMENTS

Figure 1:
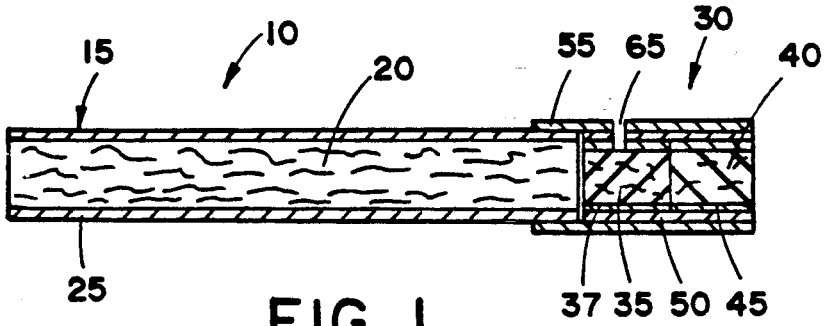
FIGS. 1 through 4 are longitudinal sectional views of smoking articles of the present invention.

A preferred embodiment of a cigarette and smokable filler material of the present invention is shown in FIG. 1. The cigarette 10 includes a generally cylindrical rod 15. The rod includes a roll of smokable material 20 wrapped in at least one layer of circumscribing outer wrapping material 25 (e.g., paper). The rod 15 is hereinafter referred to as a "smokable rod". The ends of the smokable rod 15 are open to expose the smokable material which is to be burned. The smokable rod is used by lighting one end thereof, and aerosol (e.g., smoke) is provided as a result of the combustion of the burning smokable material. As such, the smokable rod burns from the lit end thereof towards the opposite end thereof.

The cigarette 10 also includes a filter element 30 positioned adjacent one end of the smokable rod 15 such that the filter element and smokable rod are axially aligned in an end-to-end relationship, preferably abutting one another. Filter element 30 has a generally cylindrical shape, and the diameter thereof is essentially equal to the diameter of the smokable rod. The ends of the filter element are open to permit the passage of air and smoke therethrough. The preferred filter element has at least two filter segments. As shown in FIG. 1, a first filter segment is positioned adjacent the smokable rod, and preferably includes a carbonaceous filter material 35 circumscribed by a wrapping material 37; while a second filter segment is positioned at the extreme mouthend of the cigarette, and preferably includes a filter material 40, such as a gathered non-woven polypropylene web or cellulose acetate tow, circumscribed by a wrapping material 45. The filter material 40 of the segment preferably is a material which provides an aesthetically pleasing, white appearance. Each of the filter segments is manufactured using known filter rod making machinery. The two segments are combined using known plug tube combining techniques, and are held together using circumscribing wrap 50 so as to form the filter element.

The filter element 30 normally is attached to the smokable rod 15 by tipping material 55, which circumscribes both the entire length of the filter element and an adjacent region of the smokable rod. The inner surface of the tipping material 55 is fixedly secured to the outer surface of the plug wrap 50 and the outer surface of the wrapping material 25 of the smokable rod, using a suitable adhesive. The cigarette 10 can be manufactured using known cigarette making techniques and equipment. Optionally, a ventilated or air diluted cigarette is provided with an air dilution means such as a series of perforations 65 which extend through the tipping material 55, plug wrap 50 and wrapping material 37. Such ventilation can be provided to the cigarette using known techniques, such as laser perforation techniques.

Figure 2:
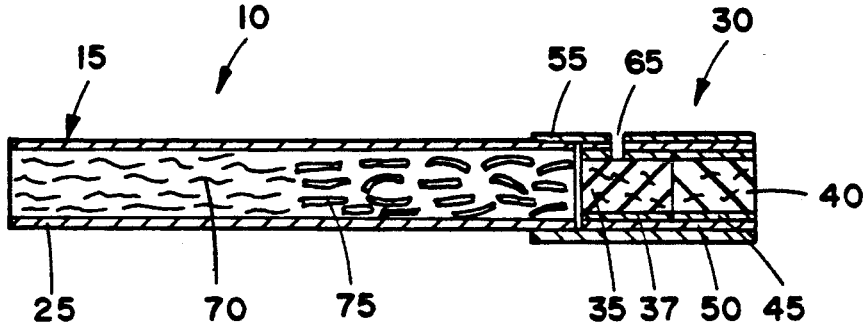

Another preferred embodiment of a cigarette and smokable filler material of the present invention is shown in FIG. 2. The cigarette 10 is generally similar to the cigarette described with reference to FIG. 1, except that the smokable material has the form of a blend which is provided in a segmented fashion. At one end of the smokable rod 15 (i.e., at the end of the cigarette to be lit) is located a first segment 70 of smokable material. At the other end of the smokable rod 15 (i.e., at the end of the smokable rod adjacent the filter element) is located a second segment 75 of smokable material. Each segment is defined or identified in terms of its composition (i.e., the composition of each segment is different). The segments are aligned in an abutting end-to-end relationship; however, there can be a certain amount of intermixing of smokable materials in the region where the two segments meet. The length which each segment of smokable material extends along the smokable rod can vary. However, the relative longitudinal length of the first segment relative to the second segment normally ranges from about 1:2 to about 2:1, with about 1:1 being preferred. Such smokable rods can be manufactured using apparatus described in U.S. Pat. Nos. 4,009,722 to Wahle et al and 4,516,585 to Pinkham.

For preferred cigarettes of the type shown in FIG. 2, the first segment 70 normally includes tobacco in some type of smokable form. Such a form of tobacco includes tobacco cut filler (e.g., tobacco laminae, processed tobacco materials, volume expanded tobacco filler, reconstituted tobacco filler materials, and the like, and blends thereof), and blends thereof with other smokable materials. Examples of processed tobacco materials are deproteinated reconstituted tobacco materials described in U.S. Pat. Nos. 4,887,618 to Bernasek et al and 4,941,484 to Clapp et al, which are incorporated herein by reference. Another example of a processed tobacco material is a tobacco material processed according to the methods set forth in U.S. Patent application Ser. No. 484,587, now U.S. Pat. No. 5,065,775 to Fagg filed Feb. 23, 1990, which is incorporated herein by reference. Preferred cigarettes also have a second segment 75 which includes a smokable material or blend of smokable materials different in overall composition from the overall composition of the smokable material(s) of the first segment 70. The first segment 70 and/or the second segment 75 include at least one smokable filler material of the present invention.

Figure 3:
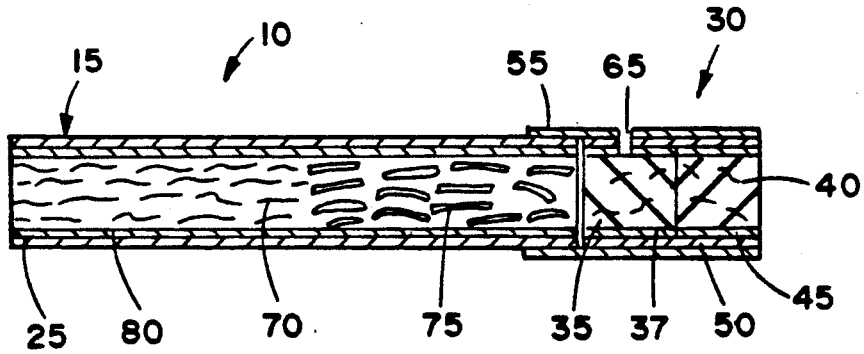

Another preferred embodiment of a cigarette of the present invention is shown in FIG. 3. The cigarette 10 is generally similar to the cigarette described with reference to FIGS. 1 and 2, except that the smokable material 20, which incorporates smokable filler material of the present invention, is wrapped or contained in a processed tobacco sheet 80, or other inner wrapper material. The processed tobacco sheet 80 normally is a reconstituted tobacco sheet which is manufactured using a paper-making process, and a single layer of the sheet circumscribes the smokable material. The smokable material wrapped in the processed tobacco sheet 80 is in turn wrapped in a single layer of circumscribing outer wrapping material 25 (e.g., cigarette paper).

Figure 4:
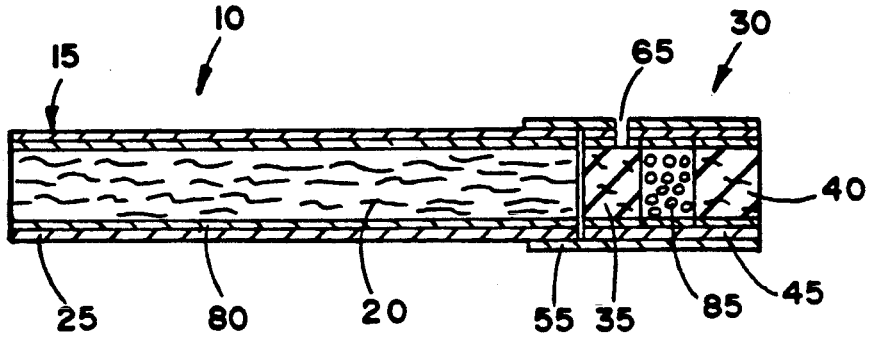

Another preferred embodiment of a cigarette of the present invention is shown in FIG. 4. The cigarette 10 is generally similar to the cigarette described with reference to FIGS. 1, 2 and 3, except that the filter element includes three segments. Segment 85, positioned between first filter material 35 and filter material 40, preferably is composed of a particulate matter such as activated carbon granules, magnesium silicate granules, silica gel particles, or the like.

The smokable material employed in the manufacture of the smokable rod can vary, and most preferably has the form of cut filler. As used herein, the term "cut filler" in referring to smokable materials is meant to include smokable materials which have a form suitable for use in the manufacture of smokable rods for cigarettes. As such, cut filler can include smokable materials which are blended and are in a form ready for cigarette manufacture. Smokable materials normally are employed in the form of strands or shreds as is common in cigarette manufacture. For example, cut filler can be employed in the form of strands or shreds cut from sheet-like or "strip" materials. Such strip materials are cut into widths ranging from about 1/5 inch to about 1/60 inch, preferably from about 1/25 inch to about 1/35 inch. Generally, the resulting strands or shreds have lengths which range from about 0.25 inch to about 3 inches. Cut filler also can have an extruded form (e.g., extruded strands), or other physically processed form.

The smokable rods of cigarettes of the present invention include smokable filler material of the present invention. The smokable filler material can be employed in a cut filler form.

One preferred type of smokable filler material of the present invention comprises an agglomerated matrix filler including an agglomerated matrix of a carbonaceous component and an inorganic component in intimate contact. The agglomerated matrix filler is in turn intimately mixed with a binding agent to provide the smokable filler material. Such a smokable filler material most preferably includes as part of the ultimate mixture, at least one aerosol forming material and/or at least one flavoring agent. If desired, other agents, which have the ability to alter the composition of the aerosol generated by the smokable filler material, can be incorporated into that smokable filler material. The agglomerated matrix filler normally includes about 80 to about 97, preferably about 90 to about 97 weight percent inorganic component, and about 3 to about 20, preferably about 3 to about 10 weight percent carbon provided by the carbonaceous component. Such a smokable filler material normally includes about 60 to about 95, preferably about 65 to about 90 weight percent agglomerated matrix filler; up to about 20, preferably about 2 to about 10 weight percent binding agent; up to about 20, preferably about 3 to about 10 weight percent aerosol forming material; and sufficient amounts of flavoring agent to provide the desired flavor characteristics. If desired, a further carbonaceous material (e.g., pyrolyzed alpha cellulose) can be incorporated into the smokable filler material, usually in amounts of up to about 10, and sometimes up to about 30 weight percent, based on the total dry weight of the smokable filler material. However, such further carbonaceous material is not a necessary component of the smokable filler material, and the smokable filler material can be absent of such carbonaceous material. The smokable filler material is combustible, and is normally employed with (e.g., blended with) another smokable material (e.g., tobacco cut filler) in order to provide a cigarette of the present invention.

One preferred type of tobacco-containing smokable filler material of the present invention comprises an agglomerated matrix filler including an agglomerated matrix of a carbonaceous component and an inorganic component in intimate contact. The agglomerated matrix filler is in turn intimately mixed with some form of tobacco and binding agent to provide the smokable filler material. Such a tobacco-containing smokable filler material preferably includes as part of the ultimate mixture, at least one aerosol forming material and/or at least one flavoring agent. If desired, other agents, which have the ability to alter the composition of the aerosol generated by the smokable filler material, can be incorporated into that smokable filler material. The agglomerated matrix filler normally includes about 80 to about 97, preferably about 90 to about 97 weight percent inorganic component, and about 3 to about 20, preferably about 3 to about 10 weight percent carbon provided by the carbonaceous component. Such a tobacco-containing smokable filler material normally includes up to about 50, typically up to about 20 weight percent of some form of tobacco; about 45 to about 90, preferably about 50 to about 85 weight percent agglomerated matrix filler; up to about 20, preferably about 2 to about 10 weight percent binding agent; up to about 20, preferably about 3 to about 15 weight percent aerosol forming material; and sufficient amounts of flavoring agent to provide desired flavor characteristics. If desired, a further carbonaceous material (e.g., pyrolyzed alpha cellulose) can be incorporated into the smokable filler material, usually in amounts of up to about 10, and sometimes up to about 30 weight percent, based on the total dry weight of the smokable filler material. However, such further carbonaceous material is not a necessary component of the smokable filler material, and the smokable filler material can be absent of such carbonaceous material. The smokable filler material is combustible and can be employed individually as the sole smokable material of a cigarette of the present invention.

Another preferred type of smokable filler material of the present invention comprises agglomerated matrix filler including an agglomerated matrix of a carbonaceous component and an inorganic component. The agglomerate matrix filler is intimately mixed with a binding agent and at least one aerosol forming material to provide a smokable filler material. Such a smokable filler material most preferably includes as part of the ultimate mixture, at least one flavoring agent and some form of tobacco. The agglomerated matrix filler normally includes about 80 to about 97, preferably about 90 to about 97 weight percent inorganic component and about 3 to about 20, preferably about 3 to about 10 weight percent carbon provided by the carbonaceous component. Such a smokable filler material normally includes up to about 20, preferably about 3 to about 15 weight percent binding agent; greater than about 20, preferably about 25 to about 80, more preferably about 30 to about 50 weight percent aerosol forming material; and less than about 80, preferably about 30 to about 70 weight percent filler component including the previously described agglomerated matrix filler. In particular, the filler component can include (i) all of the previously described agglomerated matrix filler, or (ii) a blend of the previously described agglomerated matrix filler with an inorganic filler material (e.g., precipitated calcium carbonate) and/or an organic filler material (e.g., tobacco). Amounts of flavoring agent sufficient to provide the desired flavor characteristics to the smokable filler material can be incorporated into that material. If desired, a further carbonaceous material (e.g., pyrolyzed alpha cellulose) can be incorporated into the smokable filler material, usually in amounts of up to about 10, and sometimes up to about 30 weight percent, based on the total dry weight of the smokable filler material. However, such further carbonaceous material is not a necessary component of the smokable filler material, and the filler smokable material can be absent of such carbonaceous material. The smokable filler material is combustible and can be blended with other smokable materials.

The tobacco-containing smokable filler materials of the present invention have some form of tobacco incorporated therein during manufacture. The tobacco which is employed to provide such a tobacco-containing smokable filler material can have a variety of forms, including tobacco extracts, milled tobacco laminae, tobacco fines or dust, shredded or comminuted tobacco laminae, tobacco stems, volume expanded tobacco filler and other forms of processed tobacco, and the like, and combinations thereof. Tobacco extracts are processed forms of tobacco and are provided by extracting a tobacco material using a solvent such as water, carbon dioxide, a hydrocarbon, or a halocarbon, as well as various other organic and inorganic solvents. Tobacco extracts can include spray dried extracts; freeze dried extracts; heat treated extracts, such as those extracts described in U.S Patent application Ser. Nos. 511,158, filed Apr. 19, 1990 and 452,175, now U.S. Pat. No. 5,060,699 to White, et al., filed Dec. 18, 1989; tobacco essences, such as those essences described in European Patent Application No. 326,370; and aroma oils and extracts described in U.S. Pat. No. 4,506,682 to Mueller and U.S. Patent application Ser. No. 310,413, filed Feb. 13, 1989.

The smokable filler materials of the present invention incorporate a binding agent. Examples of suitable binding agents include hydroxypropylcellulose such as Klucel H from Aqualon Co.; hydroxypropylmethylcellulose such as Methocel K4MS from The Dow Chemical Co.; hydroxyethylcellulose such as Natrosol 250 MRCS from Aqualon Co.; microcrystalline cellulose such as Avicel from FMC; methylcellulose such as Methocel A4M from The Dow Chemical Co.; and sodium carboxymethylcellulose such as CMC 7HF and CMC 7H4F from Hercules Inc. Especially preferred binding agents include the alginates, such as ammonium alginate, sodium alginate, propylene glycol alginate and potassium alginate. The alginates, and particularly the high viscosity alginates, can be employed in conjunction with controlled levels of free calcium ions. Other binding agents include starches (e.g., corn starch), guar gum, locust bean gum, pectins and xanthan gum. Combinations or blends of binding agents (e.g., a mixture of guar gum and locust bean gum) can be employed.

The smokable filler materials of the present invention can have at least one aerosol forming material and/or at least one flavoring agent incorporated therein. The preferred aerosol forming materials include polyhydric alcohols (e.g., glycerin, propylene glycol or triethylene glycol), any other materials which yield a visible aerosol, or mixtures thereof. The aerosol forming material can be provided as a portion of the binding agent (e.g., when the binding agent is propylene glycol alginate). Combinations of aerosol forming materials can be employed. The flavoring agents can vary, and include menthol, vanillin, citric acid, malic acid, cocoa, licorice, and the like, as well as combinations thereof. See, Leffingwell et al, *Tobacco Flavoring for Smoking Products* (1972).

It is sometimes desirable to incorporate a caramelizing material into the smokable filler materials of the present invention. Caramelizing materials can act to improve (i) the integrity of the ash and fire cone of the cigarette, (ii) the appearance of the smokable filler material, and (iii) the flavor characteristics of the mainstream smoke of the cigarette. The caramelizing material can be incorporated into the smokable filler material during the preparation of that material and/or applied to the surface of that material (e.g., as a powder) after the manufacture thereof. Normally, the amount of caramelizing material which is employed to treat a particular smokable filler material is such that the resulting material which incorporates the caramelizing material includes up to about 20 weight parts, typically up to about 5 weight parts, of caramelizing material and greater than about 80 weight parts of the smokable material which is treated. Examples of suitable caramelizing materials include sugars, such as glucose, fructose and sucrose; and compositions such as Carob Powder Code 1739 from M. F. Neal, Inc.

The smokable filler materials of the present invention can be surface treated with certain substances. For example, the smokable filler materials can have powdered substances applied to the surface thereof. Exemplary substances include cocoa powder, licorice powder, powdered inorganic materials (e.g., potassium carbonate or iron oxide), tobacco dust, finely divided tobacco laminae, or the like, or blends thereof. The surface treatment of the smokable filler materials can provide to those materials improved color and appearance, improved ash characteristics, and improved flavor characteristics.

The previously described agglomerated matrix filler has the form of an agglomerated matrix of an inorganic component and a carbonaceous component. The inorganic component can include particles of calcium carbonate, calcium sulfate, magnesium oxide, and the like. A particularly preferred agglomerated matrix filler is agglomerated calcium carbonate, and most preferably, agglomerated precipitated calcium carbonate. Such an agglomerated matrix filler can be prepared by providing an aqueous slurry of calcium carbonate particles and a binding material, and drying the slurry to form an agglomerated matrix of calcium carbonate (i.e., a matrix of a plurality of calcium carbonate particles spaced within a continuous or semi-continuous phase of binding material). If desired, the slurry can be volume expanded by incorporating a foaming agent therein. Examples of suitable foaming agents include linear sodium benzene sulfonates, linear alkyl sulfonates and linear alkyl ethoxy sulfates. Calcium carbonate particles which are employed to provide the agglomerated matrix typically exhibit a surface area of less than about 20 $m^2/g$, frequently less than about 10 $m^2/g$, and sometimes less than about 1 $m^2/g$, as determined using the Brunauer, Emmett and Teller (BET) method described in *J. Am. Chem. Soc,*. Vol. 60, p. 309 (1938). Typical binding materials are organic materials, such as cellulosic derivatives (e.g., sodium carboxymethylcellulose), and preferably are sugar containing materials, such as molasses, high fructose corn syrup, or Carob Powder Code 1739 from M. F. Neal, Inc. Other organic materials, such as pectins and alginates, also can be employed.

Preferably, a high solids content aqueous slurry (e.g., about 40 to about 55 weight percent solids content slurry) of calcium carbonate and binding material is spray dried to provide agglomerated particles (e.g., normally spherical particles) of calcium carbonate particles and binding material. Alternatively, the slurry can be dried by the application of heat to provide a solid mass of agglomerated calcium carbonate and binding material, and the solid mass can be ground to yield particles of the desired size. Preferably, the amount of calcium carbonate relative to binding material ranges from about 20:1 to about 2:1, more preferably about 15:1 to about 4:1, on a dry weight basis. Normally, the inorganic particles agglomerated using saccharide and polysaccharide materials tend to lose their agglomerated character when contacted with water under ambient conditions, as a result of the propensity of the saccharide and polysaccharide materials to be soluble in water.

The agglomerated matrix of inorganic component and organic binding material is subjected to heat treatment. As such, volatile components from the organic binding material are expelled, and the organic binding material is calcined to form an essentially water insoluble, clean burning carbonaceous component. Normally, the heat treatment of the agglomerated matrix filler is provided under controlled atmosphere, in order to minimize or prevent oxidation of the binding material. Preferably, the heat treatment provides a binding material which is in the form of a carbonaceous material, and in turn, provides a means for agglomerating the particles of inorganic component into a matrix form. In particular, the particles of agglomerated calcium carbonate and binding material can be heat-treated (e.g., to a temperature of up to about 625° C., and usually up to about 600° C.) using an oven, batch furnace, a fluidized bed, rotary calciner, belt calciner, or the like. For example, particles of spray dried calcium carbonate particles agglomerated using molasses can be heated in a fluidized bed having gaseous nitrogen flowing therethrough, heated at temperatures sufficient to heat the particles from about 300° C. to about 625° C., and collected. The agglomerated matrix of inorganic component and organic binding material can be subjected to heat treatment sufficient to calcine the organic binding material by subjecting the agglomerated matrix to very high temperatures (e.g., up to about 900° C.) for a short time period and under conditions sufficient to avoid decomposition of the inorganic component (e.g., when the inorganic component is calcium carbonate). However, if the inorganic component is calcium carbonate, and the calcium carbonate undergoes some decomposition during the calcining step, the agglomerated material can be re-carbonated by (i) exposing that material to carbon dioxide atmosphere, or (ii) dispersing that material in water and bubbling carbon dioxide into the dispersion.

After the calcining process, the agglomerated calcium carbonate particles normally have a calcium carbonate content of greater than about 80, frequently greater than about 90 weight percent and a carbon content provided by the carbonaceous component of greater than about 3 weight percent. Normally, the resulting agglomerated particles are screened to sizes of about −50/+325 US Mesh, and often about −80/+200 US Mesh. Preferred agglomerated calcium carbonate particles which have been calcined are essentially insoluble in water, are spherical in shape, are free flowing, and exhibit a bulk density of about 0.1 $g/cm^3$ to about 1.1 $g/cm^3$, frequently about 0.3 $g/cm^3$ to about 1 $g/cm^3$, using mercury intrusion techniques. As such, calcined agglomerated calcium carbonate particles provide an inorganic material having a bulk density less than about 2 $g/cm^3$, and preferably less than about 1 $g/cm^3$, which includes an inorganic component having a bulk density greater than about 2.5 $g/cm^3$. Normally, such calcined agglomerated calcium carbonate particles exhibit a surface area of less than about 30 $m^2/g$, and often about 10 $m^2/g$ to about 25 $m^2/g$, as determined using the BET method.

If desired, the bulk density of the calcined agglomerated inorganic filler can be lowered by digesting away part of the inorganic component with an acidulant. For example, calcined agglomerated can be dispersed in water, and an aqueous hydrochloric acid solution can be added to the resulting slurry which is agitated. The acid reacts with the calcium carbonate, and essentially does not react with the carbonaceous component. Thus, the carbonaceous component acts to hold together the remaining calcium carbonate, while a portion of the calcium carbonate reacts to produce carbon dioxide gas and water soluble calcium chloride.

Other inorganic materials can be incorporated as fillers in the smokable filler materials of the present invention. Such inorganic materials often have a fibrous, flake, crystalline, hollow, amorphous or particulate form. Examples of inorganic materials include calcium carbonate, calcium sulfate particles, magnesium oxide, magnesium hydroxide, perlite, synthetic mica, vermiculite, clays, thermally stable carbon fibers, zinc oxide, dawsonite, low density hollow spheres of calcium carbonate, glass spheres, glass bubbles, sodium silicate, thermally stable carbon microspheres, calcium sulfate fibers, hollow ceramic microspheres, alumina, calcium carbonate agglomerated using an organic material, low density processed calcium carbonate, and the like. If desired, organic materials (e.g., grains) can be incorporated as fillers into smokable filler materials of the present invention. Such inorganic and organic fillers are employed to occupy space in the smokable filler materials of the present invention.

Calcium carbonate agglomerated using ammonium alginate is an example of an agglomerated matrix filler having an inorganic component in an organic component. Other inorganic components include calcium sulfate, magnesium oxide and magnesium carbonate. Such an agglomerated matrix filler is provided by preparing an aqueous slurry of calcium carbonate particles and hydrated alginate, and drying the slurry to form an agglomerated matrix of calcium carbonate (i.e., a matrix of a plurality of calcium carbonate particles spaced within a continuous or semi-continuous phase of alginate). If desired, the slurry can be volume expanded by incorporating a foaming agent therein. Examples of suitable foaming agents include linear sodium benzene sulfonates, linear alkyl sulfonates and linear alkyl ethoxy sulfates. Preferably, a high solids content aqueous slurry of calcium carbonate and alginate is spray dried to provide agglomerated particles (e.g., normally spherical particles) of calcium carbonate particles and alginate. Alternatively, the slurry can be dried by the application of heat to provide a solid mass of agglomerated calcium carbonate and alginate, and the solid mass can be ground to yield particles of the desired size. Preferably, the amount of calcium carbonate relative to alginate ranges from about 99:1 to about 10:1, on a dry weight basis. Typically, the particles of calcium carbonate agglomerated using alginate are essentially insoluble in water under ambient conditions. In particular, the essentially water insoluble character of the alginate in the agglomerated matrix filler tends to limit to a great degree any propensity of the agglomerated matrix filler to lose its agglomerated character when contacted with water under ambient conditions. The agglomerated matrix filler is rendered insoluble due to the interaction of the alginate with calcium ions of the calcium carbonate. If desired, the agglomerated matrix filler can be treated with a dilute solution of acid to decompose a portion of the calcium carbonate and liberate calcium ions and the resulting calcium ions can act to render insoluble the alginate component of the agglomerated matrix filler.

The agglomerated matrix filler having an inorganic component and an organic component can incorporate a variety of other organic components. For example, the organic component can be pectin, which has a tendency to become essentially water insoluble upon interaction with calcium. Alternatively, agglomerated matrix filler having a polysaccharide organic component can be treated with divalent ions (e.g., calcium, barium, cobalt, iron or manganese ions) or trivalent ions (e.g., iron or aluminum ions) to render the polysaccharide essentially water insoluble. As yet another example, a slurry of polysaccharide material (e.g., ethylcellulose) and inorganic component particles can be provided in a non-aqueous solvent (e.g., alcohol) and dried, resulting in the formation of an agglomerated matrix filler which is essentially water insoluble.

Another type of inorganic material which can be incorporated into smokable filler materials of the present invention is a low density inorganic filler. Such a filler is provided by providing particles of a calcium salt, decomposing the anion of the salt and contacting the particles with carbon dioxide. Examples of suitable salts include calcium propionate, succinate, tartrate, stearate, salicylate, palmitate, oleate, lactate, gluconate, citrate, ascorbate, acetylsalicylate and benzoate. Other suitable salts include calcium salts of saccharides and polysaccharides. Such salts are subjected to conditions sufficient to decompose the anion thereof, which usually involves subjecting the salt to heat treatment under carbon dioxide atmosphere.

One method for providing a low density inorganic filler involves heating calcium lactate particles screened to −80/+170 US Mesh at about 600° C. for about 8 hours under a steady 228 ml/min. flow of carbon dioxide gas, so as to provide a material which has undergone about a 65 percent weight loss. About 20 weight parts of the material is charged into about 80 weight parts water, and the resulting slurry is contacted with sufficient hydrochloric acid solution to lower the pH thereof to about 6.8. The material then is removed from the water, washed with water, dried, and screened to a particle size of −80/+170 US Mesh. Such material is greater than about 95 weight percent calcium carbonate, and exhibits a bulk density of about 0.4 g/cm$^3$, as determined using mercury intrusion techniques.

Typically, the smokable filler materials of the present invention are provided by forming an aqueous slurry of binding agent and the other components of that smokable filler material, casting the slurry as a sheet, and drying the cast material to form a relatively dry, workable sheet. Techniques and equipment for casting a slurry as a sheet will be apparent to the skilled artisan. Other materials, such as calcium acetate, potassium carbonate, pH control agents, urea, amino acids, potassium chloride and/or calcium hydroxide, can be incorporated into the slurry. Sequestering agents (e.g., diammonium hydrogen orthophosphate, potassium hexametaphosphate, sodium citrate or tetrasodium pyrophosphate) can be incorporated into the slurry in amounts sufficient to control the free calcium ion concentration in the slurry. The cast material can be dried at ambient temperatures or at elevated temperatures. Further, an aqueous solution of calcium salts can be applied to the cast slurry. The resulting dried sheet can be cut or broken into "strip" form, and later can be cut or shredded into cut filler form.

The smokable filler materials of the present invention can be provided using a paper-making process. In particular, an aqueous slurry of a cellulosic material (e.g., softwood pulp, hardwood pulp, flax fibers and/or shredded tobacco stems) and the previously described filler can be cast as a mat on a fibrous belt or wire screen, and dried to the desired moisture level. Normally, a slurry, dispersion or solution of flavoring agents, tobacco extracts, tobacco parts, aerosol forming materials, and the like, can be applied to the mat (e.g., as a spray), and the resulting mat can be dried further to form a sheet. The resulting dried sheet can be cut or broken in "strip" form, and later can be cut or shredded into cut filler form. Techniques and equipment for making a paper-type sheet will be apparent to the skilled artisan.

The smokable filler materials of the present invention can be extruded into the desired shape using suitable extrusion techniques. See, for example, the types of processes described in U.S. Pat. No. 4,880,018 to Graves, Jr. et al, which is incorporated herein by reference. Alternatively, an aqueous slurry of the components of the smokable material and an alginate binding agent can be extruded into an aqueous solution of calcium ions (e.g., an aqueous solution of calcium chloride), collected and dried. If desired, extruded smokable filler materials can be physically processed (e.g., subjected to treatment using rollers, etc.) and formed into the desired shape.

The smokable rods of cigarettes of the present invention often include a physical mixture or blend of smokable materials. The blend can include two or more smokable filler materials of the present invention, or a physical mixture of at least one smokable filler material of the present invention with at least one other smokable material. Certain preferred cigarettes include within such a blend, a sufficient amount of at least one of the smokable filler materials of the present invention such that the smokable material within each cigarette comprises at least about 1 percent of the carbonaceous material, based on the total weight of the blend. In particular, cigarettes having such types of smokable filler materials and having low porosity paper outer wrappers (e.g., having outer wrappers having less than about 5 CORESTA units) have the propensity to sustain smolder (e.g., not self-extinguish), when smoked under FTC smoking conditions. FTC smoking conditions consist of 35 ml puffs of 2 second duration, taken every 60 seconds.

The smokable filler materials of the present invention can be blended with tobacco cut filler. The type of tobacco can vary, and can include flue-cured, Burley, Maryland and Oriental tobaccos, as well as the rare and specialty tobaccos, and blends thereof. Such tobacco cut filler can be provided in the form of tobacco laminae; volume expanded or puffed tobacco laminae; processed tobacco stems such as cut-rolled or cut-puffed stems; reconstituted tobacco materials, such as (i) deproteinated tobacco materials described in U.S. Pat. Nos. 4,887,618 to Bernasek et al and 4,941,484 to Clapp et al, (ii) a phosphate-containing reconstituted tobacco material described in U.S. Pat. Nos. 3,353,541 and 3,420,241 to Hind et al, and 3,386,449 to Hind, as well as U.S. Patent application Ser. Nos. 406,637, filed Sep. 13, 1989 now U.S. Pat. No. 4,987,906 to Young, et al., and 461,216, filed Jan. 5, 1990, (iii) a reconstituted tobacco material described in U.S. Patent application Ser. No. 272,156, now U.S. Pat. No. 4,962,774 to Thomasson, et al., filed Nov. 16, 1988 and *Tobacco Encyclopedia.* edit. by Voges, p. 389, TJI (1984), (iv) the reconstituted tobacco materials described in U.S. Patent application Ser. Nos. 416,332, filed Sep. 29, 1989 and 414,833, filed Sep. 29, 1989; or blends thereof.

Smokable materials can be cased and top dressed as is conventional during various stages of cigarette manufacture. For example, flavoring agents can be applied to the smokable material as is commonly performed when cigarette cut filler is processed. Suitable flavoring agents include vanillin, cocoa, licorice, menthol, and the like. Flavor modifying agents can be applied to the smokable material. A flavor modifying agent in the form of levulinic acid can be applied to the smokable material (e.g., in amounts ranging from about 0.01 to about 2 percent, normally from about 0.1 to about 1 percent, preferably about 0.2 to about 0.6 percent, based on the dry weight of the smokable material). Another flavor modifying agent in the form of potassium carbonate can be applied to the smokable material (e.g., in amounts of less than about 5 percent, normally about 1 to about 3 percent, based on the dry weight of the smokable material). Aerosol forming materials and humectants, such as glycerin and propylene glycol, can be applied to the smokable material. Such components conveniently are applied to the smokable material as casing and top dressing components.

The preferred wrapping material which provides the smokable rod is a cigarette wrapping material having a low air permeability value. Such a wrapping material normally has an air permeability of less than about 5 CORESTA units, often less than about 3 CORESTA units, and frequently less than about 1 CORESTA unit. Typical wrapping materials are cigarette paper wrappers. Suitable wrapping materials are cigarette paper wrappers available as DD-71-1, DD-71-6, MTR-1021, P-2831-60-2, P-2831-60-3, P-2831-60-4, P-2831-60-5, P-2674-110, P-2831-60-1 and DD-100-2 from Kimberly-Clark Corp. Suitable low porosity cigarette paper wrappers are commercially available, and can have various levels of burn chemicals, fluxing agents, etc., incorporated therein. Particularly preferred are cigarette paper wrappers which include an amount of a polymeric film forming agent sufficient to provide a paper having the desirably low air permeability value. For example, a sufficient amount of a solution of a polymeric (e.g., carboxymethyl cellulose or ethylcellulose) film forming agent can be applied to a paper wrapper. The selection of the polymeric film forming agent will be apparent to the skilled artisan.

The optional polymeric film forming agent can be applied to the paper wrapper during the manufacture of the paper, or applied as a print or paint after manufacture of the paper is complete. Typically, the film forming agent is applied to the paper as a dilute solution (e.g., at a concentration of about 0.2 to about 5 weight percent relative to the solvent) for ease of processing. The amount of film forming agent applied to the paper wrapper depends upon factors such as the permeability of the paper and the film forming capabilities of the film forming agent. Typically, the amount of film forming agents employed ranges from about 1 to about 10 percent, based on the dry weight of the paper. For example, a 5 weight percent solution of ethylcellulose in ethanol or sodium carboxymethylcellulose in water can be applied to cigarette paper using a size press, and the paper can be dried to provide a non-wetting, moisture resistant paper wrapper having a porosity of less than about 1 CORESTA unit, preferably less than about 0.5 CORESTA unit.

The smokable rods and the resulting cigarettes can be manufactured in any known configuration using known cigarette making techniques and equipment. Smokable rods often include smokable material wrapped in a single layer of wrapping material, although a double layer of two types of wrapping materials can be employed. See, for example, U.S. Patent application Ser. No. 528,302, filed May 24, 1990, which is incorporated herein by reference.

Cigarettes having smokable rods which are double wrapped with two layers of wrapping material preferably include one of the previously described low porosity paper wrappers as the outer wrappers. The inner wrapper can vary, but typically is a tobacco-containing wrapping material. Exemplary inner wrappers are paper wrappers which include about 3 parts Java tobacco stem parts and about 1 part wood pulp, and are available from Kimberly-Clark Corp. as P-2249-115 and P-2831-23-3. Other suitable inner wrapping materials include tobacco parts and carbonaceous materials, and are available from Kimberly-Clark Corp. as P-2540-94-A, P-2540-94-C and P-2540-94-D. The inner wrapping materials (i) can include burn chemicals (e.g., potassium citrate, potassium acetate or potassium succinate), and/or (ii) act as a substrate for flavors (e.g., menthol or vanillin) or flavor precursors (e.g., vanillin glucoside or ethylvanillin glucoside).

Typically, the smokable rod has a length which ranges from about 30 mm to about 70 mm, preferably about 35 to about 60 mm; and a circumference of about 17 mm to about 27 mm, preferably about 22 mm to about 25 mm. Short smokable rods (i.e., having lengths from about 30 to about 50 mm) can be employed, particularly when smokable materials having a relatively high packing density are employed.

The packing density of the smokable material contained within the outer wrapping material can vary. Typical packing densities for smokable rods of cigarettes of the present invention range from about 150 to about 400 mg/cm$^3$. Normally, packing densities of such smokable rods range from about 200 to about 380 mg/cm$^3$, frequently about 250 to about 360 mg/cm$^3$, particularly when relatively short (i.e., less than 50 mm long) smokable rods are employed.

The cigarettes of the present invention preferably include a filter element, and most preferably a filter element having more than one segment. For example, a preferred filter element has two or more filter segments. Typically the segments of the preferred filter elements each have lengths which ranges from about 10 mm to about 30 mm; and circumferences of about 17 mm to about 27 mm, preferably about 22 mm to about 25 mm. The plug wrap which circumscribes the filter material of each filter segment typically is a conventional paper plug wrap, and can be either air permeable or essentially air impermeable.

Preferred filter materials of one of the filter segments include carbonaceous materials (e.g., activated carbon particles, charcoal particles, or carbon paper). An example of a particularly preferred filter material is provided by gathering a tobacco/carbon paper available as P-144-BAC from Kimberly-Clark Corp. Such filter materials reduce the levels of certain gas phase components from the mainstream smoke which passes to the mouth of the smoker. As such, preferred filter materials of that segment act to reduce the levels of any smoke components which may provide an off-taste or other undesirable characteristics to the mainstream smoke.

Preferred filter materials of another of the filter segments normally include fibrous materials. An example of a suitable filter material is a gathered nonwoven polypropylene web. A particularly preferred nonwoven polypropylene sheet-like web is available as PP-100-F from Kimberly-Clark Corp. Another example of a suitable filter material is a cellulose acetate tow. Particularly preferred cellulose acetate tow items include (i) 8 denier per filament/40,000 total denier, and (ii) 8 denier per filament/15,000 total denier, (iii) 8 denier per filament/25,000 total denier, and (iv) 8 denier per filament/30,000 total denier. Plasticizers, such as triacetin, propylene glycol or triethyl citrate, can be combined with the filler materials.

Another filter segment can have a filter material in the form of a gathered web of nonwoven thermoplastic (i.e., hydrophobic) fibers in intimate contact with a water soluble tobacco extract so as to provide an extract-containing filter material. A highly preferred web is a nonwoven web of polypropylene fibers available as PP 200 SD from Kimberly-Clark Corp. Exemplary filter segments and filter elements are described in U.S. Patent application Ser. Nos. 414,835, filed Sep. 29, 1989 and 518,597, filed May 3, 1990. Such segments can provide enhanced flavor characteristics to the mainstream smoke which passes therethrough.

Yet another filter segment can include a tobacco paper material as the filter material. For example, a filter material can have the form of a gathered web of tobacco paper available as P-144-B from Kimberly-Clark Corp.

The filter element segments suitable for use in this invention can be manufactured using known cigarette filter making techniques. Filter elements can be manufactured from cellulose acetate tow using known techniques. Filter elements can be manufactured from carbon paper, tobacco paper and a sheet-like nonwoven polypropylene web using filter making techniques described in U.S. Pat. No. 4,807,809 to Pryor et al, which is incorporated herein by reference. Alternatively, particles of charcoal or activated carbon can be incorporated into the filter element using a so-called "triple filter" configuration by positioning the particles between two segments of suitable filter materials.

The filter elements can have low, moderate or high filtration efficiencies. Preferred filter elements have minimal mainstream aerosol (i.e., smoke) removal efficiencies while maintaining the desirable draw characteristics of the cigarette. Such minimal smoke removal efficiencies are provided by "low efficiency" filter elements. Low efficiency filter elements have a minimal ability to remove mainstream smoke particulates. See, Keith in Schemeltz's *The Chemistry of Tobacco and Tobacco Smoke,* p. 157 (1972). Generally, low efficiency filter elements provide less than about 40 weight percent mainstream smoke particulate removal efficiency.

Tipping material circumscribes the filter element and an adjacent region of the smokable rod such that the tipping material extends about 3 mm to about 6 mm along the length of the smokable rod. Typically, the tipping material is a conventional paper tipping material. Tipping materials of varying porosities can be employed. For example, the tipping material can be essentially air impermeable, air permeable, or treated (e.g., by mechanical or laser perforation techniques) so as to have a region of perforations, openings or vents thereby providing a means for providing air dilution to the cigarette. The total surface area of the perforations and the positioning of the perforations along the periphery of the cigarette can be varied in order to control the performance characteristics of the cigarette.

For air diluted or ventilated cigarettes of the present invention, the amount of air dilution can vary. Typically, the amount of air dilution for an air-diluted cigarette is greater than about 25 percent, and frequently greater than about 40 percent. The upper limit for air dilution for a cigarette typically is less than about 75 percent, more frequently less than about 65 percent. As used herein, the term "air dilution" is the ratio (expressed as a percentage) of the volume of air drawn through the air dilution means to the total volume of air and aerosol (i.e., smoke) drawn through the cigarette and exiting the extreme mouthend portion of the cigarette. See, Selke et al, *Beitr. Zur Tabak. In.,* Vol. 4, p. 193 (1978).

Cigarettes of the present invention, when smoked, provide a flavorful mainstream aerosol. The mainstream aerosol of such cigarettes can yield low levels of incomplete combustion products as well as low levels of gas phase components. The cigarettes burn at an acceptable rate, and maintain static smolder, at least when smoked under FTC smoking conditions. The cigarettes, when smoked, have an ash and fire cone which is not overly cohesive, and hence, is not overly long. However, the cigarettes also provide an ash and fire cone which exhibit good integrity.

Cigarettes of the present invention, when smoked, generally yield less than about 20 mg, preferably less than about 10 mg of sidestream "tar" per cigarette, as determined using the apparatus and techniques described by Proctor et al, *Analyst.* Vol. 113, p. 1509 (1988). Such cigarettes normally provide more than about 5 puffs, preferably more than about 6 puffs per cigarette, when smoked under FTC conditions. Normally, cigarettes of the present invention provide less than about 20 puffs, and often less than about 15 puffs, when smoked under FTC conditions.

The following examples are provided in order to further illustrate the invention but should not be construed as limiting the scope thereof. Unless otherwise noted, all parts and percentages are by weight.

EXAMPLE 1

A. Preparation of a Tobacco-Containing Smokable Filler Material

An agglomerated matrix filler is provided as follows:

Into a low shear mixer are charged about 832 parts tap water at ambient temperature, about 757 parts precipitated particulate calcium carbonate available as Albacar 5970 from Pfizer Inc., and about 267 parts molasses. The calcium carbonate has a rosettic structure and an average particle size (i.e., diameter) of about 2 microns. The molasses is available as Refiner's Syrup from Savannah Sugar Co., and has a solids/water content of about 3.7:1. The resulting mixture is agitated for about 5 to about 10 minutes to provide a slurry having a solids content of about 52 percent and a viscosity of about 1,200 cps as measured by a Brookfield LVT viscometer with cylindrical LV spindle No. 4.

The slurry is spray dried by continuously pumping the slurry at about 6 lbs./min. at a feed pressure of about 475 to about 500 psig to a spray dryer. The spray dryer is a Bowen Type commercial unit equipped with an SD-046 nozzle, and operated in a commercial mode. The inlet temperature is about 470° F., and the outlet temperature is about 260° F. The resulting spray dried particles have a generally spherical shape, and a moisture content of below about 2 percent. The particles are screened to a particle size of −70/+200 US Mesh.

The spray dried particles are placed on a 12 inch by 36 inch steel tray to a thickness of about 0.5 inch. The tray then is passed into a continuous belt furnace at a rate of about 8 to about 12 inches/min., and is subjected to heating under nitrogen atmosphere at above about 600° C. for about 10 minutes, and at above about 400° C. for about 20 minutes. The oven is set at about 720° C., and the tray is subjected to a maximum air temperature of about 670° C. during that time. The heated particles are removed from the furnace into a cooling zone for about 1 hour under nitrogen atmosphere, and cooled to ambient temperature.

The calcined particles so collected are black, are spherical in shape, are free flowing, and resist wetting. The particles are about 93 percent calcium carbonate, and exhibit a bulk density of about 0.5 g/cm$^3$. The particles each are an agglomerated matrix of a plurality of precipitated calcium carbonate particles spaced within a carbonaceous material.

The tobacco-containing smokable filler material is provided as follows:

Into tap water at ambient temperature and maintained at high shear in a blender is charged about 2 parts sodium carboxymethylcellulose available as CMC 7HF from Hercules Inc. Then, about 4 parts glycerin is charged into the water. After a consistent slurry is provided, about 6 parts spray dried tobacco extract is charged into the slurry. Then, about 18 parts of the previously described calcined agglomerated matrix filler particles are folded into the slurry. The resulting slurry, which is an intimate mixture of the aforementioned components, has a solids content of about 25 percent, and exhibits a pH of about 7.

The slurry is cast to about a 0.02 inch thickness onto a high density polyethylene sheet and air dried. The resulting tobacco-containing smokable filler material is a very dark brown sheet having (i) a thickness of about 0.01 inch, (ii) a density of about 0.5 g/cm$^3$, (iii) a moisture content of about 2 to about 6 percent, and (iv) a flexible and pliable character. The sheet is provided in strip form, about 2 inches by about 3 inches in size. The strips are shredded at about 32 cuts per inch to provide a combustible tobacco-containing smokable cut filler.

B. Preparation of a Cigarette

Cigarettes substantially as shown in FIG. 1 are provided as follows:

The cigarettes each have a length of about 84 mm and a circumference of about 24.8 mm, and include a smokable rod having a length of about 57 mm, a first filter segment having a length of about 15 mm and a second filter segment having a length of about 12 mm. The first and second filter segments form a filter element. Each filter segment is attached to each smokable rod using nonporous tipping paper. For each cigarette, the tipping paper circumscribes the filter element and about a 4 mm length of the smokable rod in the region adjacent the filter element. The filter elements are not ventilated.

The smokable rod includes the previously described tobacco-containing smokable filler material in cut filler form.

The first filter segment is provided by gathering a 11.75 inch wide web of tobacco and carbon paper available as P-144-BAC from Kimberly-Clark Corp. using the filter rod forming apparatus described in Example 1 of U.S. Pat. No. 4,807,809 to Pryor et al. The plug wrap for the filter segment is available as Reference No. 5831 from Ecusta Corp. The first filter segment is positioned adjacent the smokable rod.

The second filter segment is provided by gathering a 11.75 inch wide web of non-woven polypropylene web available as PP-100-F from Kimberly-Clark Corp. using the filter rod forming apparatus described in Example 1 of U.S. Pat. No. 4,807,809 to Pryor et al. The plug wrap for the filter segment is available as Reference No. 5831 from Ecusta Corp. The second filter segment is positioned adjacent the first filter segment, at the extreme mouth end of the cigarette.

The cigarette paper wrapper exhibits an air permeability of about 1 CORESTA unit. The cigarette paper is available as MTR-1021 from Kimberly-Clark Corp.

Smokable cigarette rods are provided using known techniques. In particular, the smokable material is circumscribed by a single layer of paper wrap. The weight of the smokable filler material within each cigarette rod is about 0.92 g.

The cigarettes are employed by burning the smokable rod such that the smokable material within the paper wrapper burns to yield smoke. When employed, such cigarettes yield very low levels of visible sidestream smoke and essentially no sidestream odor. Cigarettes smoked and tested in this manner each yield 8.0 puffs, 18.7 mg wet total particulate matter (WTPM), 1.8 mg nicotine, 4.8 mg water and 4.8 mg glycerin, under FTC smoking conditions. The cigarettes do not self-extinguish during the smolder period experienced during FTC smoking conditions.

EXAMPLE 2

A. Preparation of a Smokable Filler Material

Into tap water at ambient temperature and maintained at high shear in a blender is charged about 3 parts sodium carboxymethylcellulose available as CMC 7HF from Hercules Inc. Then, about 6 parts glycerin is charged into the water. After a consistent slurry is provided, about 91 parts of the calcined agglomerated calcium carbonate described in Example 1 is folded into the slurry. The resulting slurry, which is an intimate mixture of the aforementioned components, has a solids content of about 25 percent, and exhibits a pH of about 7.

The slurry is cast to about a 0.02 inch thickness onto a flat high density polyethylene sheet and air dried. The resulting smokable filler material is a very dark brown sheet having (i) a thickness of about 0.01 inch, (ii) a density of about 0.5 g/cm$^3$, (iii) a moisture content of about 2.5 to about 6 percent, and (iv) a flexible and pliable character. The sheet is provided in strip form, about 2 inches by about 3 inches in size. The strips are shredded at about 32 cuts per inch to provide a smokable cut filler.

The smokable filler material has a powder mixture applied to the surface thereof. The powder mixture is about 9 parts cocoa powder and about 1 part iron oxide, and the powder mixture is applied such that the resulting smokable filler material includes about 3 percent of that powder mixture. The powder mixture provides a brown color to the combustible smokable cut filler.

B. Preparation of a Cigarette

Cigarettes substantially as shown in FIG. 3 are provided as follows:

The cigarettes each have a length of about 84 mm and a circumference of about 24.8 mm, and include a smokable rod having a length of about 57 mm, a first filter segment having a length of 15 mm and a second filter segment having a length of about 12 mm. The first and second segments form a filter element. Each filter segment is attached to each smokable rod using nonporous tipping paper. For each cigarette, the tipping paper circumscribes the filter element and about a 4 mm length of the smokable rod in the region adjacent the filter element. The filter elements are ventilated to about 60 percent air dilution by providing a ring of perforations through the tipping paper and plug wrap of the filter element circumscribing the cigarette about 12 mm from the extreme mouthend thereof.

The smokable rod includes two longitudinally positioned segments of smokable material within two layers of wrapper. The inner surface of the outer wrapper directly contacts the outer surface of the inner wrapper. The inner wrapper circumscribes the smokable material. The first segment of smokable material is positioned at the end of the smokable rod which is to be lit, and the second segment of smokable material is positioned at the end of the smokable rod which is adjacent the filter element. Each segment extends about 28.5 mm along the smokable rod.

The first segment of smokable material is about 0.6 g of a blend of about 65 parts of the previously described smokable filler material and 35 parts tobacco cut filler (strands of tobacco laminae cut at about 32 cuts per inch). The tobacco cut filler portion is a blend of about 30 parts volume expanded flue-cured tobacco, about 20 parts volume expanded Oriental tobacco, about 45 parts flue-cured tobacco, and about 5 parts of a spray dried aqueous Burley tobacco extract. The tobacco cut filler then is top dressed with a mixture of glycerin and potassium carbonate, such that the resulting cut filler includes about 91 percent tobacco, about 3 percent potassium carbonate and about 6 percent glycerin.

The second segment is composed entirely of about 0.6 g of the previously described smokable filler material.

The first filter segment is provided by gathering a 11.75 inch wide web of tobacco and carbon paper available as P-144-BAC from Kimberly-Clark Corp. using the filter rod forming apparatus described in Example 1 of U.S. Pat. No. 4,807,809 to Pryor et al. The plug wrap for the filter segment is available as Reference No. 5831 from Ecusta Corp. The first filter segment is positioned adjacent the smokable rod.

The second filter segment is cellulose acetate tow (8 denier per filament/40,000 total denier) which is plasticized with triacetin, and is circumscribed by nonporous paper plug wrap. The second filter segment is positioned adjacent the first filter segment, at the extreme mouth end of the cigarette.

The cigarette paper outer wrapper of the smokable rod exhibits an air permeability of about 0 CORESTA unit. The paper includes about 4.2 percent potassium citrate and about 1.1 percent sodium carboxymethylcellulose. The cigarette paper is available as P-2831-60-1 from Kimberly-Clark Corp.

The inner wrapper of the smokable rod is a tobacco-containing paper available as P-2831-23-3 from Kimberly-Clark Corp.

The cigarettes are employed by burning the smokable rod such that the smokable material within the paper wrapper burns to yield smoke. When employed, such cigarettes yield very low levels of visible sidestream smoke and essentially no sidestream odor. Cigarettes smoked and tested in this manner each yield 9.5 puffs, 5.2 mg wet total particulate matter (WTPM), 0.5 mg nicotine, 0.5 mg water and 1.5 mg glycerin, under FTC smoking conditions. The cigarettes do not self-extinguish during the smolder period experienced during FTC smoking conditions.

EXAMPLE 3

A smokable filler material is prepared as follows:

Into about 300 ml tap water at ambient temperature is dispersed about 5 g of a high viscosity ammonium alginate available as Amoloid HV from Kelco Division of Merck & Co., Inc. To this is charged about 6 g glycerin, and then about 89 g of the calcined agglomerated calcium carbonate described in Example 1. The resulting slurry is agitated for about 15 minutes using an egg beater type mixer, until the slurry exhibits a smooth texture. The slurry then is cast onto a high density polyethylene sheet at a thickness of about 0.02 inch and air dried. The resulting sheet exhibits good tensile strength, exhibits a flexible and pliable character, is water resistant, and does not undergo any significant amount of cracking during drying. The resulting sheet has a moisture content of about 20 percent, and a thickness of about 0.02 inch. The sheet is shredded at 32 cuts per inch to provide a combustible smokable cut filler.

EXAMPLE 4

A tobacco-containing smokable filler material is prepared as follows:

Into about 300 ml tap water at ambient temperature is dispersed about 5 g of the ammonium alginate described in Example 3. To this is charged about 6 g glycerin, then about 2 g diammonium phosphate, and then about 5 g of a spray dried aqueous extract of Burley tobacco. To this is charged about 82 g of the calcined agglomerated calcium carbonate described in Example 1. The resulting slurry is agitated gently using an egg beater type mixer until the slurry exhibits a smooth texture. The slurry then is cast onto a high density polyethylene sheet surface at a thickness of about 0.02 inch and air dried. The resulting sheet exhibits good tensile strength, exhibits a flexible and pliable character, is water resistant, and does not undergo any significant amount of cracking during drying. The resulting sheet has a moisture content of about 20 percent and a thickness of about 0.02 inch. The sheet is shredded at 32 cuts per inch to provide a combustible smokable cut filler.

EXAMPLE 5

A smokable filler material is prepared as follows:

Into about 300 ml tap water at ambient temperature is dispersed about 5 g of the ammonium alginate described in Example 3. To this is charged about 20 g glycerin, and then about 40 g of the calcined agglomerated calcium carbonate described in Example 1. The resulting slurry is mixed gently for about 15 minutes using an egg beater type mixer. The resulting slurry is extruded at ambient temperature using a 50 ml syringe through a die having a generally circular orifice having a diameter of about 1 mm. The extrudate exits the die into a solution of about 98 parts tap water and about 2 parts calcium chloride ambient temperature. Within about 30 seconds, extrudate is removed from the aqueous calcium chloride solution, and resembles a cylinder having a diameter of 1 mm. The extrudate is dried at ambient conditions. The extrudate is passed through the nip of two closely spaced, smooth surfaced metal rollers to produce ribbon about 2 mm wide and about 0.4 mm thick. The resulting material is suitable for use as a smokable filler material.

EXAMPLE 6

A tobacco-containing smokable filler material is provided as follows:

Into about 320 parts tap water at ambient temperature is dispersed about 4 parts of the ammonium alginate described in Example 3. To this is charged about 10 parts glycerin, then about 5 parts of powdered Java tobacco laminae, and then about 81 parts of the calcined agglomerated calcium carbonate described in Example 1. The resulting slurry is agitated until the slurry exhibits a smooth texture. The slurry is cast onto a flat high density polyethylene sheet at a thickness of about 0.02 inch, and air dried to a moisture content of about 12 percent and a thickness of about 0.012 inch. The resulting sheet is cut at about 32 cuts per inch to provide a combustible smokable cut filler.

EXAMPLE 7

A. Preparation of a Smokable Filler Material

A tobacco-containing smokable filler material is provided using a paper-making process as follows:

Into about 400 parts tap water at ambient temperature is dispersed about 2 parts hardwood pulp having a Canadian Standard Freeness of about 95. A slurry is provided by agitating the mixture in a high shear blender at high speed for about 4 minutes. Into the slurry is charged about 25 parts of the calcined agglomerated calcium carbonate described in Example 1. As such, the amount of cellulose pulp in the slurry is less than about 12 percent, based on the solids content of the slurry. The resulting slurry is agitated gently to provide a uniform, homogeneous slurry.

The homogeneous slurry is cast from a headbox as a mat onto a 100 mesh (U.S.) fabric. The slurry is metered from the headbox using a rotating drum having retractable metering veins which unload the slurry from the drum to the fabric. The rotating drum moves linearly relative to the surface of the fabric. The ratio of the speed of the perimeter of the rotating drum to the linear speed of the drum is about 1.6:1. A vacuum of about −25 inches water is pulled on the bottom of the fabric to provide a mat having a thickness of about 0.02 inch. A mixture of water, glycerin, spray dried aqueous tobacco extract is sprayed onto both sides of the mat. The aqueous spray dried tobacco extract is about 30 parts spray dried Burley tobacco and about 70 parts spray dried flue cured tobacco. Sufficient mixture is sprayed onto the mat so as to provide a sheet having about 20 parts tobacco extract, about 6 parts glycerin and about 74 parts mat, on a dry weight basis. The mat then is maintained overnight at a temperature of about 76° F. and at a relative humidity of about 60 percent to provide a paper-type material.

The mat then is cut into rectangular strips, about 2 inches by about 3 inches in size. The strip is shredded at 32 cuts per inch using a paper shredder available as Model 52 AM from Michael Business Machines Corp. The resulting strands of smokable cut filler then are dried at about 90° C. in an oven to a moisture level of about 3 percent.

B. Preparation of a Cigarette

Cigarettes substantially as shown in FIG. 3 are provided as follows:

The cigarettes each have a length of 84 mm and a circumference of 24.8 mm, and include a smokable rod having a length of 57 mm, a first filter segment having a length of 15 mm and a second filter segment having a length of 12 mm. The first and second segments form a filter element. Each filter element is attached to each smokable rod using nonporous tipping paper. For each cigarette, the tipping paper circumscribes the filter element and a 4 mm length of the smokable rod in the region adjacent the filter element. The filter elements are ventilated to about 63 percent air dilution by providing a ring of perforations through the tipping paper and plug wrap of the filter element circumscribing the cigarette about 12 mm from the extreme mouthend thereof.

The smokable rod includes the previously described smokable filler material wrapped within two layers of wrapper.

The first filter segment is provided by gathering a 11.75 inch wide web of tobacco and carbon paper available as P-144-BAC from Kimberly-Clark Corp. using the filter rod forming apparatus described in Example 1 of U.S. Pat. No. 4,807,809 to Pryor et al. The plug wrap for the filter segment is available as Reference No. 5831 from Ecusta Corp. The first filter segment is positioned adjacent the smokable rod.

The second filter segment is cellulose acetate tow (8 denier per filament/40,000 total denier) which is plasticized with triacetin, and is circumscribed by nonporous paper plug wrap. The second filter segment is positioned adjacent the first filter segment, at the extreme mouth end of the cigarette.

The cigarette paper outer wrapper of the smokable rod exhibits an air permeability of about 0 CORESTA unit. The paper includes about 4.2 percent potassium citrate and about 1.1 percent sodium carboxymethylcellulose. The cigarette paper is available as P-2831-60-1 from Kimberly-Clark Corp.

The inner wrapper of the smokable rod is a tobacco containing paper available as P-2831-22-2 from Kimberly-Clark Corp.

The weight of each cigarette is about 1.26 g.

The cigarettes are employed by burning the smokable rod such that the smokable material within the paper wrapper burns to yield smoke. When employed, such cigarettes yield very low levels of visible sidestream smoke and essentially no sidestream odor. Cigarettes smoked and tested in this manner each yield about 9 puffs, 7.3 mg wet total particulate matter (WTPM), 0.74 mg nicotine, 0.5 mg water and 1.2 mg glycerin, under FTC smoking conditions.

EXAMPLE 8

A smokable filler material is provided as follows:

Into about 240 parts tap water is charged about 4 parts of the ammonium alginate described in Example 3, followed by about 17.5 parts glycerin, then about 17.5 parts propylene glycol, and finally about 61 parts of the calcined agglomerated calcium carbonate described in Example 1. The resulting slurry is agitated using an egg beater type mixer, until the slurry exhibits a smooth texture. The slurry is cast onto a high density polyethylene sheet at a thickness of about 0.015 inch and air dried. The resulting dried sheet has a thickness of about 0.011 inch, an exhibits a density of about 0.745 g/cm$^3$.

Cigarettes are provided from the smokable filler material as follows:

The smokable material is circumscribed by a reconstituted tobacco paper-type wrapper containing Java tobacco stem parts and wood pulp. The inner wrapper is available as P-2831-23-3 from Kimberly-Clark Corp. The inner wrapper then is circumscribed by a paper wrapper available as P-2831-60-1 from Kimberly-Clark Corp. The cigarette includes the filter element and tipping material, substantially as described in Example 7.

EXAMPLE 9

A smokable filler material is provided as follows:

Into about 720 parts tap water is charged about 12 parts of the ammonium alginate described in Example 3, followed by about 48 parts glycerin, and finally about 40 parts of the calcined agglomerated calcium carbonate described in Example 1. The resulting slurry is agitated using an egg beater type mixer, until the slurry exhibits a smooth texture. The slurry is cast onto a high density polyethylene sheet at a thickness of about 0.015 inch and air dried. The resulting dried sheet has a thickness of about 0.007 inch, and exhibits a density of about 0.503 g/cm$^3$.

Cigarettes are provided from the smokable filler material as follows:

The smokable material is circumscribed by a reconstituted tobacco paper-type wrapper containing Java tobacco stem parts and wood pulp. The inner wrapper is available as P-2831-23-3 from Kimberly-Clark Corp. The inner wrapper then is circumscribed by a paper wrapper available as P-2831-60-1 from Kimberly-Clark Corp. The cigarette includes the filter element and tipping material, substantially as described in Example 7.

EXAMPLE 10

A smokable filler material is provided as follows:

Into about 720 parts tap water is charged about 12 parts of the ammonium alginate described in Example 3, followed by about 24 parts glycerin, then about 24 parts propylene glycol, and finally about 40 parts of the calcined agglomerated calcium carbonate described in Example 1. The resulting slurry is agitated using an egg beater type mixer, until the slurry exhibits a smooth texture. The slurry is cast onto a high density polyethylene sheet at a thickness of about 0.015 inch and air dried. The resulting dried sheet has a thickness of about 0.007 inch, and exhibits a density of about 0.47 g/cm$^3$.

Cigarettes are provided from the smokable filler material as follows:

The smokable material is circumscribed by a reconstituted tobacco paper-type wrapper containing Java tobacco stem parts and wood pulp. The inner wrapper is available as P-2831-23-3 from Kimberly-Clark Corp. The inner wrapper then is circumscribed by a paper wrapper available as P-2831-60-1 from Kimberly-Clark Corp. The cigarette includes the filter element and tipping material, substantially as described in Example 7.

EXAMPLE 11

A tobacco-containing smokable filler material is provided as follows:

Into about 400 ml tap water at ambient temperature is charged about 24.2 g glycerin and about 12.1 g propylene glycol, and the resulting mixture is agitated at a high rate using a high shear blender. To the resulting mixture is added about 7.2 g of the ammonium alginate described in Example 3, and the mixture which results is agitated at high speed using a blender for about 15 minutes in order to disperse the alginate in the liquid and hydrolyze the alginate. About 10 g precipitated calcium carbonate available as Code No. 2A from Pfizer Inc. is dispersed in about 100 ml of tap water; charged into the aqueous slurry of glycerin, propylene glycol and alginate; and the resulting mixture is agitated until a smooth slurry results. The resulting slurry is transferred to an egg beater type mixer, and about 10 g of the agglomerated calcium carbonate described in Example 1 is added to the slurry while the mixture is gently agitated. Into the slurry is added about 36.4 g of a mixture of volume expanded flue-cured and Burley tobacco laminae which has been ground to a particle size of −35/+80 US Mesh, and the mixture is gently agitated. About 3 g diammonium phosphate is dissolved in about 200 g water; charged into the slurry; and the resulting slurry is gently agitated for about 5 minutes.

The resulting slurry is cast to about a 0.03 inch thickness on a high density polyethylene sheet and air dried for about 80 minutes. Then, an aqueous solution of 1 percent calcium chloride is sprayed onto the top side of the cast slurry so as to apply about 1 percent calcium chloride to the cast slurry, on a dry weight basis. The slurry then is allowed to air dry to provide a relatively stiff sheet. The resulting sheet is shredded at about 32 cuts per inch to provide a smokable filler material.

EXAMPLE 12

Particles of calcium carbonate agglomerated with an alginate are provided as follows:

Into a blender is charged about 750 ml tap water, and then about 20 g glycerin. While the mixture is gently agitated, about 10 g of the ammonium alginate described in Example 3 is slowly added thereto, so as to disperse the alginate in the water. The resulting mixture is transferred into a 1 liter jar, sealed, and gently rolled overnight to hydrate the alginate.

A slurry of 250 g precipitated calcium carbonate available as Code No. 2A from Pfizer Inc. in 250 g tap water is provided. Then, the slurry is added to 200 g of the water/glycerin/alginate mixture. The resulting slurry is agitated gently so as to provide a slurry having a smooth texture.

The slurry is cast onto a high density polyethylene sheet at a thickness of about 0.04 inch, and air dried to provide pieces of dried sheet about 6 inches by about 6 inches in size. The resulting dried sheet is hand ground to a fine particle size and screened to −50 US Mesh.

A tobacco-containing smokable filler material is prepared as follows:

Into a high shear blender is charged about 225 ml tap water, and into the water is dispersed about 5 g of the ammonium alginate described in Example 3. The resulting mixture is gently agitated at ambient temperature for about 15 minutes, until the alginate is hydrated. Then, about 20 g glycerin is added to the mixture, followed by about 25 ml tap water. To the mixture is added about 16.7 g of an "American blend" of tobacco cut filler which has been ground to a powder. Then, about 25 ml tap water is added to the mixture. The resulting mixture is agitated until a smooth slurry results. To the slurry is added a mixture of about 13.8 g of the calcined agglomerated calcium carbonate described in Example 1 and about 13.8 g of particles of calcium carbonate agglomerated with ammonium alginate. The resulting slurry is agitated until the slurry exhibits a smooth texture. The resulting slurry is cast onto a high density polyethylene sheet at a thickness of about 0.025 inch and air dried.

EXAMPLE 13

A smokable filler material is provided as follows:

Into about 2,000 ml tap water is charged about 400 g of the calcined agglomerated calcium carbonate described in Example 1. The resulting slurry is agitated using a magnetic stirring bar, and into the slurry is added in a drop-wise manner about 500 ml of a 3 molar aqueous hydrochloric acid solution. The slurry then is filtered and washed with about 4,000 ml water. The resulting digested agglomerated matrix calcium carbonate exhibits a bulk density and weighs about 104 g.

Into a high shear mixer set at high speed containing about 430 g tap water is added about 5 g sodium carboxymethylcellulose available as CMC 7HF from Hercules Inc. Then, about 6 g glycerin is charged into the mixture. Agitation is ceased, and about 89 g of the previously described digested agglomerated matrix calcium carbonate is folded into the mixture. The resulting slurry is gently agitated until a smooth slurry results. The slurry is sieved through a 20 US Mesh screen to remove large clumps therefrom. The slurry is cast at about a 0.02 inch thickness and air dried. The resulting sheet has a thickness of about 0.015 inch, and exhibits a density of about 0.31 g/cm$^3$.

EXAMPLE 14

A tobacco-containing smokable filler material is provided as follows:

Into about 190 ml tap water at ambient temperature is mixed about 24.2 g of glycerin and 12.1 g of propylene glycol. The mixture is agitated using a high shear blender. To this is added about 3.6 g of the ammonium alginate described in Example 3. Agitation is continued for about 15 minutes until the ammonium alginate is completely dispersed and hydrated. Then about 10 g of precipitated calcium carbonate is added slowly and mixed until the material is evenly dispersed and the slurry becomes smooth. Then about 10 g of agglomerated calcium carbonate, as described in Example 1, is added and gently stirred until the mix is uniform. This mixture was cast at 0.02 inches onto a plastic surface. After drying for 1 hour, an aqueous solution of 1 percent calcium chloride is sprayed onto the top side as described in Example 6. This sheet is allowed to dry in air under ambient conditions. Next, into about 300 ml tap water at ambient temperature is added about 3.6 g of ammonium alginate and the mix is agitated until the alginate is dispersed and hydrated. Then about 14.6 g of Burley tobacco powder, about 2.9 g of milled Turkish tobacco, about 18.9 g of milled flue-cured tobacco; and about 13.5 g of propylene glycol is added and mixed until uniform. This mix was cast at about 0.07 inches over the sheet previously described in this Example. The resulting laminated sheet is shredded at 32 cuts per inch.

What is claimed is:

1. A cigarette comprising:

(a) a smokable filler material including an intimate mixture of (i) agglomerated matrix filler in particulate form having particles of inorganic filler spaced within a continuous or semi-continuous phase of a carbonaceous binding material, and (ii) tobacco; and (b) wrapping material circumscribing the smokable filler material.

2. The cigarette of claim 1 wherein the smokable filler material includes a binding agent.

3. The cigarette of claim 1 wherein the wrapping material is a paper having a porosity of less than about 5 CORESTA units.

4. The cigarette of claim 1 or 3 wherein the agglomerated matrix filler comprises a calcium carbonate component and a carbonaceous component.

5. The cigarette of claim 4 further including tobacco cut filler.

6. The cigarette of claim 4 wherein the agglomerated matrix filler comprises greater than about 90 weight percent calcium carbonate component and greater than about 3 weight percent carbon provided by the carbonaceous component.

7. The cigarette of claim 1 or 3 wherein the agglomerated matrix filler comprises an inorganic component spaced within a continuous or semi-continuous phase of a carbonaceous binding component, and the agglomerated matrix filler is in particulate form exhibiting a particle size of −50/+325 U.S. Mesh.

8. The cigarette of claim 1 further including tobacco cut filler.

9. The cigarette of claim 1 wherein the smokable material includes up to about 50 weight percent tobacco, about 45 to about 90 percent agglomerated matrix filler; up to about 20 weight percent binding agent;

and up to about 20 weight percent aerosol forming material.

10. A cigarette comprising:

(a) smokable filler material including an intimate mixture of (i) agglomerated matrix filler, (ii) tobacco, and (iii) a binding agent which includes ammonium alginate; and (b) wrapping material circumscribing the smokable filler material.

11. The cigarette of claim 1, 2 or 10 wherein the tobacco has the form of a tobacco extract.

12. The cigarette of claim 11 wherein the smokable filler material includes an aerosol forming material.

13. The cigarette of claim 11 further including tobacco cut filler.

14. A smokable filler material comprising an agglomerated matrix filler material in particulate form having particles of inorganic filler spaced within a continuous or semi-continuous phase of a carbonaceous binding material.

15. The smokable filler material of claim 14 including a binding agent.

16. The smokable filler material of claim 14 or 15 including an aerosol forming material.

17. The smokable filler material of claim 16 wherein the aerosol forming material includes a polyhydric alcohol.

18. The smokable filler material of claim 16 further comprising tobacco.

19. The smokable filler material of claim 14 wherein the agglomerated matrix filler comprises an inorganic component spaced within a continuous or semi-continuous phase of a carbonaceous binding component, and the agglomerated matrix filler is in particulate form exhibiting a particle size of −50/+325 U.S. Mesh.

20. The smokable filler material of claim 19 wherein the inorganic component includes particles of calcium carbonate.

21. The smokable filler material of claim 19 wherein the agglomerated matrix filler comprises greater than about 90 weight percent inorganic component and greater than about 3 weight percent carbon provided by the carbonaceous component.

22. The smokable filler material of claim 21 further comprising tobacco.

23. The smokable filler material of claim 19 including about 60 to about 95 weight percent agglomerated matrix filler, up to about 20 percent binding agent, and up to about 20 weight percent aerosol forming material.

24. The smokable filler material of claim 23 further comprising tobacco.

25. The smokable filler material of claim 19 consisting essentially of about 60 weight percent agglomerated matrix filler, up to about 20 weight percent binding agent, and up to about 20 weight percent aerosol forming material.

26. The smokable filler material of claim 25 further comprising tobacco.

27. The smokable filler material of claim 22, 24 or 26 wherein the tobacco has the form of a tobacco extract.

28. The smokable filler material of claim 22, 24 or 26 including up to about 50 weight percent tobacco, about 45 to about 90 weight percent agglomerated matrix filler, up to about 20 weight percent binding agent, and up to about 20 weight percent aerosol forming material.

29. The smokable filler material of claim 14 or 19 wherein the agglomerated matrix filler is (i) in particulate form, and (ii) exhibits a bulk density of less than about 1 g/cm$^3$.

30. The smokable filler material of claim 14, 15 or 19 further comprising tobacco.

31. The smokable filler material of claim 30 wherein the tobacco has the form of an extract.

32. A cigarette comprising:

(a) smokable filler material including agglomerated matrix filler in particulate form having particles of inorganic filler spaced within a continuous or semi-continuous phase of a carbonaceous binding material; and (b) wrapping material circumscribing the smokable filler material.

33. The cigarette of claim 32 wherein the smokable filler material includes a binding agent.

34. The cigarette of claim 32 wherein the smokable material includes an aerosol forming material.

35. The cigarette of claim 32 wherein the wrapping material is a paper having a porosity of less than about 5 CORESTA units.

36. The cigarette of claim 32 or 35 wherein the agglomerated matrix filler comprises a calcium carbonate component and a carbonaceous component.

37. The cigarette of claim 36 wherein the smokable filler material comprises about 60 to about 95 weight percent agglomerated matrix filler, up to about 20 weight percent binding agent, and up to about 20 weight percent aerosol forming material.

38. The cigarette of claim 36 wherein the agglomerated matrix filler comprises greater than about 90 weight percent calcium carbonate component and greater than about 3 weight percent carbon provided by the carbonaceous component.

39. The cigarette of claim 32 or 35 wherein the agglomerated matrix filler comprises an inorganic component spaced within a continuous or semi-continuous phase of a carbonaceous binding component, and the agglomerated matrix filler is in particulate form exhibiting a particle size of −50/+325 U.S. Mesh.

40. The cigarette of claim 35 further including tobacco cut filler.

41. A cigarette comprising:

(a) smokable filler material including (i) agglomerated matrix filler, and (ii) a binding agent including ammonium alginate; and (b) wrapping material circumscribing the smokable filler material.

42. The cigarette of claim 32, 33 or 41 further including tobacco cut filler.

* * * * *

UNITED STATES PATENT AND TRADEMARK OFFICE

CERTIFICATE OF CORRECTION

PATENT NO. : 5,105,836

DATED : April 21, 1992

INVENTOR(S) : Jeffery S. Gentry, et al.

It is certified that error appears in the above—identified patent and that said Letters Patent is hereby corrected as shown below:

In the Title Page under [75] Inventors:

Line 3, after "Mead; insert --of New Jersey--.

Page 2 following U.S. PATENT DOCUMENTS, add:

--OTHER PUBLICATIONS, APV Anhydro Bulletin No. 165 and APV Anhydro Bulletin No. 701--.

Col. 24, line 62, "80" should be --30--.
Col. 27, line 55, after "60" insert --to about 90--.

Signed and Sealed this

Twenty-first Day of September, 1993

Bruce Lehman

*Attest:*

BRUCE LEHMAN

*Attesting Officer*

*Commissioner of Patents and Trademarks*